US008534877B1

(12) United States Patent
Leadford et al.

(10) Patent No.: US 8,534,877 B1
(45) Date of Patent: Sep. 17, 2013

(54) LUMINAIRE OPTICAL SYSTEMS

(75) Inventors: Kevin F. Leadford, Evergreen, CO (US); Carl T. Gould, Golden, CO (US); James P. Yates, Charleston, IL (US)

(73) Assignee: Stingray Energy Systems LLC, Charleston, IL (US)

( * ) Notice: Subject to any disclaimer, the term of this patent is extended or adjusted under 35 U.S.C. 154(b) by 396 days.

(21) Appl. No.: 12/384,425

(22) Filed: Apr. 2, 2009

Related U.S. Application Data

(60) Provisional application No. 61/072,973, filed on Apr. 3, 2008.

(51) Int. Cl.
*F21V 7/00* (2006.01)

(52) U.S. Cl.
USPC ..... 362/310; 362/277; 362/285; 362/296.01

(58) Field of Classification Search
USPC ..... 362/277, 285, 296.01, 310
See application file for complete search history.

(56) References Cited

U.S. PATENT DOCUMENTS

| | | | | |
|---|---|---|---|---|
| 3,283,140 | A * | 11/1966 | Rex | 362/309 |
| 4,021,659 | A * | 5/1977 | Wiley | 362/297 |
| 5,791,768 | A * | 8/1998 | Splane, Jr. | 362/280 |
| 6,494,596 | B1 * | 12/2002 | Burroughs | 362/348 |
| 2007/0064415 | A1 * | 3/2007 | Wood | 362/205 |

* cited by examiner

*Primary Examiner* — Diane Lee
*Assistant Examiner* — Sean Gramling
(74) *Attorney, Agent, or Firm* — Kenneth E. Darnell

(57) ABSTRACT

Optical systems capable of use in a variety of lighting applications particularly including industrial high bay and similar applications, the systems of the invention deliver energy efficient and effective light distribution through use of dual reflector arrangements wherein an inner reflector having a divergent and convergent profile is stationary relative to a lamp to form an inner reflector/lamp assembly, a prismatic outer reflector being displaceable relative to the inner reflector/lamp assembly to produce differing photometric distributions.

11 Claims, 13 Drawing Sheets

LUMINAIRE OPTICAL SYSTEMS

CROSS REFERENCE TO RELATED APPLICATIONS

This application is a nonprovisional application of Provisional Application Ser. No. 61/072,973, filed Apr. 3, 2008, upon which priority is claimed.

BACKGROUND OF THE INVENTION

1. Field of the Invention

The invention relates generally to optical systems useful in industrial lighting applications and particularly to energy efficient and high performance luminaires incorporating such optical systems utilizing independent and concentrically aligned reflectors adjustable relative to each other and operating in tandem to produce a versatile range of tailored photometric distributions.

2. Description of the Prior Art

High bay luminaires have traditionally found particular use in warehouses, manufacturing facilities and increasingly in retail situations wherein ceiling heights require lighting adequate for illumination of particular areas within an overall space. Low bay luminaries of similar configuration find utility in lighting applications having differing lighting requirements. Conventional luminaires of these types typically provide uniform illumination over the distribution area of such facilities, such uniform illumination typically being less than adequate for at least certain areas in which a greater degree of light intensity is desirable, such as in an area in which an assembly line is located, as opposed to an area wherein a lesser degree of illumination is necessary such as walkways or the like where tasks requiring greater degrees of illumination are not performed. In typical warehouses, for example, luminaires are disposed between fifteen to seventy feet above floor level. In such situations, more light is desired at a working surface as opposed to upper portions of a storage rack or near ceiling levels. Even so, adequate illumination is necessary at these upper portions of storage racks and the like so that fork lift or "picking" operators can place and remove items from these racks. Typical high bay or low bay luminaires are incapable of providing adequate lighting levels at these spaced locations within the volumetric confines of a working space or the like without the use of high wattage lamping, thereby creating unnecessary illumination near ceilings in order to create adequate lighting near floor level. Such conventional luminaires typically use 400 watt lamps as well as lamping ranging up to 1000 watts in order to address these needs, the use of such lamps being extraordinarily wasteful of energy in the form of the electrical power necessary for operation of such lamping even without consideration for the additional energy required for space cooling due to the heat generated by this high wattage lamping.

The art has previously addressed certain of these failings through use of dual reflector lighting systems such as are disclosed by Thomas et al in U.S. Pat. No. 5,582,479; by Walker et al in U.S. Pat. No. 6,068,388 and by Splane, Jr. in U.S. Pat. Nos. 5,791,768; 6,273,590 and 6,464,377. In these patents, an inner reflector located within an outer reflector, such as is typically used as a sole reflector in a high bay luminaire or the like, can be displaced relative to the outer reflector and relative to lamping in order to produce a desired lighting distribution for any given luminaire in a building having a multiplicity of luminaires for illumination of the building. These luminaires function with lamping of a lower wattage to produce desired lighting distributions and illumination levels than would be expected given the performance of conventionally used high bay luminaires such as those disclosed in U.S. Pat. No. 3,401,258 to Guth and U.S. Pat. No. 4,173,037 to Henderson, Jr. et al, these and many other high bay luminaires being commonly used over at least the last fifty years. In these prior art luminaires, an opaque or transparent prismatic reflector typically having an inverted bowl shape houses an energy inefficient lamp in order to provide adequate illumination levels within a given volumetric space. Even though Henderson, Jr. et al disclose an outer reflector and an asymmetrical inner reflector, the inner reflector is mounted for rotational adjustment relative to the vertical axis of the disclosed luminaire and thus functions only to produce asymmetrical light distribution and does not permit energy efficiencies. Similarly, well known luminaires such as those disclosed by Cochran in U.S. Pat. No. 1,286,535 include dual reflectors incapable of displacement relative to each other to vary lighting distributions.

High bay luminaires are further disclosed by Jaffari et al in U.S. Pat. No. 6,478,454; by Burroughs in U.S. Pat. No. 6,494,596; by Sitzema, Jr., et al in U.S. Pat. No. 6,698,908; by Barnes et al in U.S. Pat. No. 4,839,781; by Taylor et al in U.S. Pat. No. 4,903,180; by Sales in U.S. Pat. No. 6,910,785 and by Leadford in U.S. Pat. No. 7,025,476. With the exception of Jaffari et al, these patents focus on transparent single reflector luminaires having prismatic structures which function to reflect light from lamping to illuminate a space. Jaffari et al disclose a metal primary or outer reflector capable of directing light upwardly of the luminaire. Burroughs treats a prismatic reflector on upper portions of inside surfaces in order to eliminate hot spots at nadir. Sitzema, Jr. et al provide a peened specular collar with a primary reflector to achieve a more narrow distribution in an acrylic high bay luminaire. Barnes et al disclose a commonly employed reflector/refractor used in luminaires and the like, such luminaires configured only with the reflector/refractor so disclosed being incapable of adjustment of light distribution characteristics along with an inability to provide desirable illumination levels with lamping of a lower wattage and thus greater energy efficiency than is possible in light of the disclosure provided herein. Sales and Leadford disclose single reflectors useable in high bay and similar luminaires, these reflectors being intended to utilize shaped prisms for direction of light from lamping housed within the reflectors.

Prismatic structures useable in luminaires such as high bay luminaires and the like are further described by Pearce in U.S. Pat. No. 5,416,684; by Shadwick in U.S. Pat. No. 3,800,138 and by Franck in U.S. Pat. No. 2,818,500. Franck discloses a number of basic lighting principles relating to prismatic structures formed of transparent materials such as high grade glass. Among these structures are radial scallops on interior surfaces of a reflector and configured to avoid light being incident on the valley and ridge radii of externally disposed prisms. Shadwick discloses scalloped structures that function to blur bleed-through lamp image viewed through a refractor functioning as a reflective structure. Pearce provides a fixed secondary metal reflector within an enclosing refractor in order to divert light away from a non-optical base of the refractor. Guth, previously mentioned, discloses in U.S. Pat. No. 3,401,258 faceted fluting in the form of radial scallops formed near the aperture of a metal or otherwise opaque reflector and used for glare control. Yet another prismatic reflector disclosed as a high bay luminaire is provided by Taylor et al in U.S. Pat. No. 4,903,180 with a transparent shroud for protection of the reflector from dust accumulation that degrades reflector performance.

The prior art fails to disclose optical systems particularly useful in high bay and similar luminaries as well as in luminaires capable of use in other lighting applications, which optical systems are capable of energy efficiencies and enhanced performance relative to presently available luminaires. Accordingly, a need for optical systems capable of energy efficiency and improved performance is long-felt and is addressed by the presently disclosed optical systems, said optical systems of the invention being characterized as dual reflector systems having precision optics utilizing highly specular reflective finishes particularly disposed on an inner reflector having radial waves or scallops either concave or convex, the assembly of the inner reflector and a clear point source lamp being displaceable relative to a prismatic outer reflector for maximization of optical control, tailoring of beam shape to optimally suit a variety of functions within a space to be illuminated, enhanced glare control and precision light placement as well as energy efficiencies afforded by the ability to use lower wattage lamping than has previously been necessary for suitable work plane illuminance for a given lighting application. The optical systems of the invention utilize two independent and concentrically aligned reflectors working in tandem to smoothly and efficiently produce a versatile range of tailored photometric distributions, the present systems being useful in lighting applications advantageously employing adjustable beams such as accent lighting, ellipsoidal downlighting, stage lighting, landscape lighting, aircraft and automotive reading lighting and even in flashlights as well as in high bay and low bay industrial and retail applications. The optical systems of the invention are now disclosed with particular reference to a high bay luminaire capable of exceptional performance with substantial energy efficiencies.

SUMMARY OF THE INVENTION

The invention provides optical systems useful in luminaires suitable in a variety of lighting applications wherein an adjustable beam is advantageous, these applications including but not being limited to industrial and retail lighting such as in warehouses, manufacturing facilities and retail establishments, particularly those establishments characterized by ceiling heights greater than approximately fifteen feet and which ordinarily are provided with luminaires commonly referred to as high bay luminaires. Other applications include but are not limited to accent lighting, ellipsoidal downlighting, stage lighting, landscape lighting, aircraft and automotive reading lighting, low bay lighting, task lighting and even "flash lights".

The optical systems of the invention are particularly characterized in preferred embodiments by the use of at least two independent and concentrically aligned reflectors capable of tandem function to smoothly and efficiently produce a broad range of tailored photometric distributions. The present systems permit substantial increases in light output for a given energy expenditure, that is, for lamping of a given wattage, or substantial energy efficiencies for a given light output and utilization, that is, lamping of a lower wattage can be employed to provide lighting performance otherwise provided only by a higher wattage lamp operable with greater energy expenditure. The optical systems of the invention preferably employ clear point source lamping such as metal halide lamping including pulse-start metal halide and ceramic metal halide with clear outer glass envelopes, that is, non-phosphor coated bulbs or jackets. Use of such lamping in concert with the preferred precision optics of the invention permits maximization of optical control, tailoring of beam shape to optimally suit a variety of applications, enhanced glare control and precision light placement while taking full advantage of the long life, low maintenance, energy efficiency and high lumen output of the preferred lamping.

The optics of the present systems as are particularly embodied in luminaires such as high bay luminaires disclosed herein preferably include an outer or primary prismatic reflector having concentric scalloping and radial scalloping on interior surfaces, the intersections of such scalloping defining a multiplicity of optically efficient and visually appealing micro-regions. The preferred outer reflector houses an inner reflector movable in tandem with the preferred lamping to vary beam shape and thereby permit adjustability at anytime after original installation of individual luminaires to meet the requirements of a particular application. The inner reflector is preferably formed with radial scallops over its entire surface, preferred scalloping being convex as viewed from "inside" of the reflector. The scalloped inner reflector is preferably provided with a highly specular reflective finish to yield a specular reflectivity approaching 95%. Divergent and convergent profiling of the preferred inner reflector provides particularly improved performance especially with lamping such as high intensity discharge and the like that substantially functions as point source lamping. The inner reflector can be alternatively configured with a wave or concave pattern to provide desired performance.

Embodiments of the invention particularly useful as high bay luminaires are preferably configured with ventilation apertures formed in upper portions of the outer reflector in order to efficiently remove heat from the interior of the luminaire. Further, the high bay luminaires of the invention are preferably further provided with a prism shield surmounting the outer reflector and formed with ventilation apertures aligned with the ventilation apertures formed in the outer reflector so that ventilation is assured. The prism shield primarily functions to protect the outer reflector from dust accumulation that can degrade prism performance.

As will be appreciated with particular reference herein to high bay luminaire embodiments of the invention, the mounting of the inner reflector in fixed relation to the arc of the preferred lamping defines a "ceiling" of the optical system regardless of displacement or positional adjustment of the lamping and thus the inner reflector relative to the outer reflector to provide a desired lighting distribution on surfaces beneath the aperture of the outer reflector. This relationship between lamping, inner reflector and outer reflector plays a substantial role in the ability to provide the advantages of the invention as enumerated herein.

Accordingly, it is an object of the invention to provide optical systems particularly embodying multiple reflectors working in tandem to tailor photometric distribution to varying lighting applications while maximizing energy efficiencies.

It is another object of the invention to provide independent and concentrically aligned reflectors operable preferably with clear point source lamping, an inner reflector being fixed in relation to the lamping and being relatively displaceable with the lamping relative to an outer reflector to tailor beam shape and provide desired light outputs and distributions yielding improved performance with energy efficiencies.

It is a further object of the invention to provide an optical system having prismatic outer reflector housing an inner reflector having a divergent and convergent profile fixed positionally to a point source lamp, the inner reflector and lamp being displaceable relative to the outer reflector or vice versa to produce a versatile range of tailored photometric distribution while maximizing energy efficiencies.

Further objects and advantages of the invention will become more readily apparent in light of the following detailed description of the preferred embodiments.

DESCRIPTION OF THE PREFERRED EMBODIMENTS

The disclosures of U.S. Pat. Nos. 1,286,535; 2,818,500; 3,401,258; 3,800,138; 4,173,037; 4,839,781; 4,903,180; 5,416,684; 5,582,479; 5,791,768; 6,068,388; 6,273,590; 6,464,377; 6,478,454; 6,494,596; 6,698,908; 6,910,785 and 7,025,476 are incorporated hereinto by reference.

Figure 1:
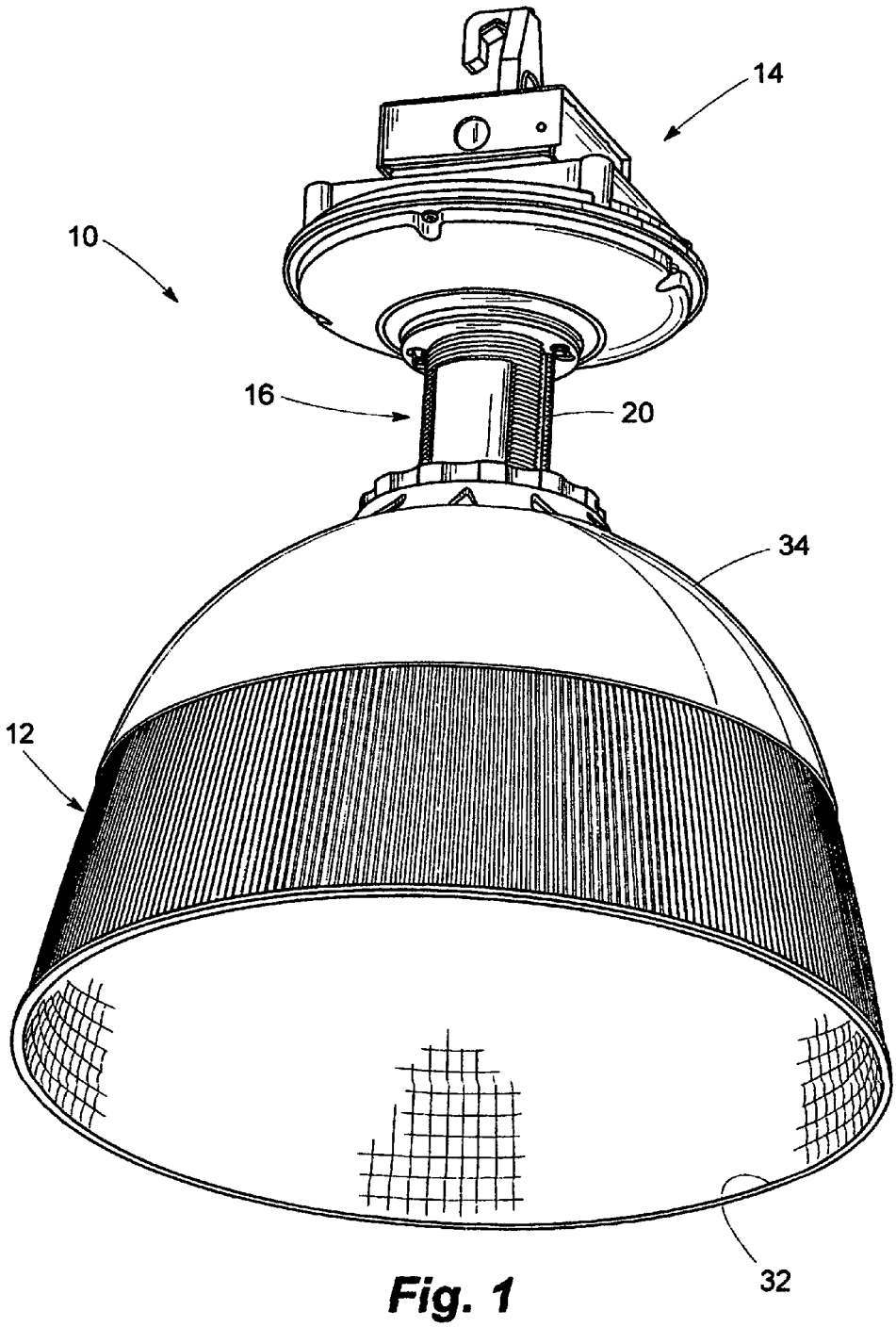
FIG. 1 is a perspective view of a high bay luminaire having an adjustable dual reflector optical system configured according to a preferred embodiment of the invention.
Figure 2:
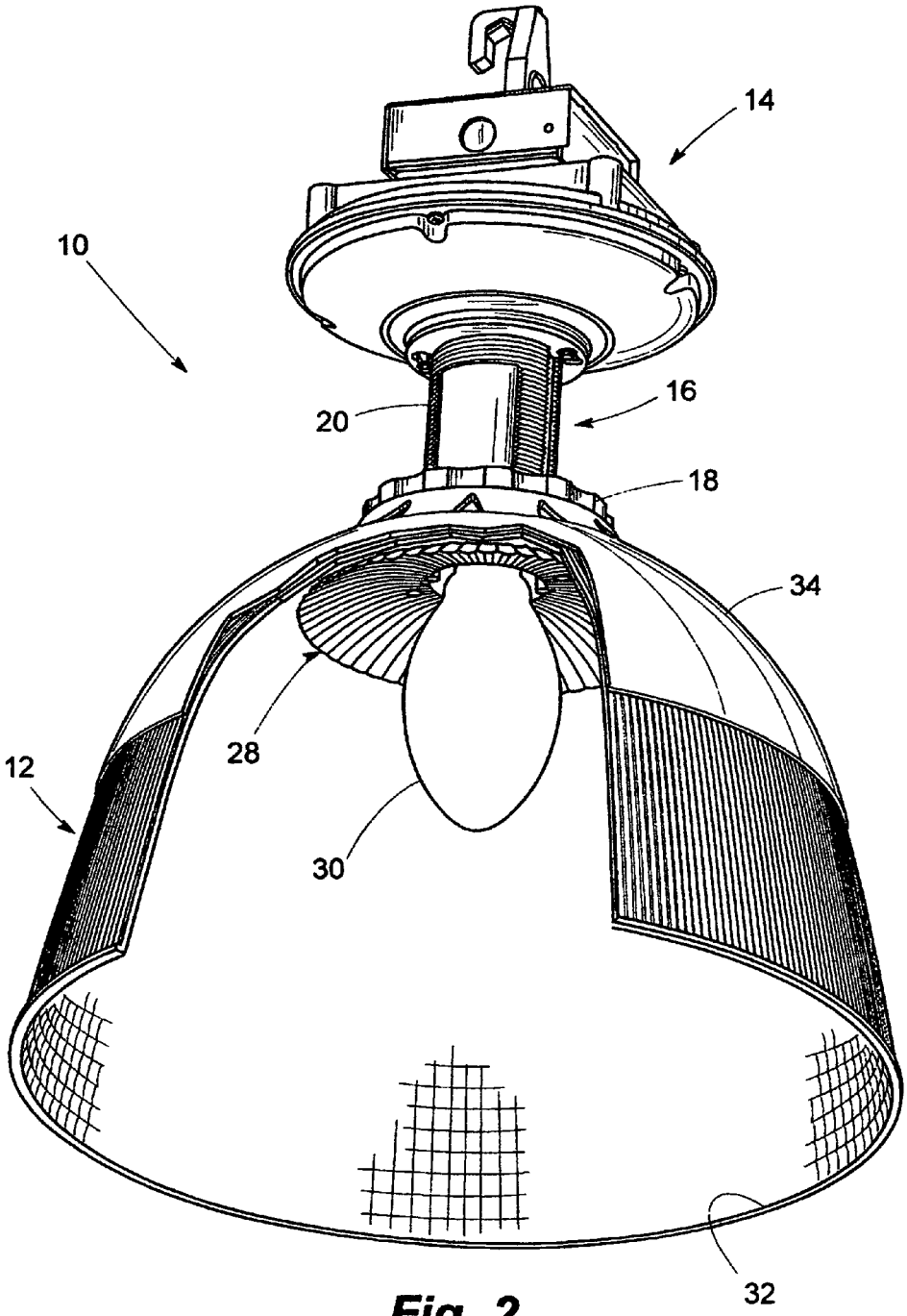
FIG. 2 is a perspective view partially cut away of the high bay luminaire shown in FIG. 1.
Figure 3A:
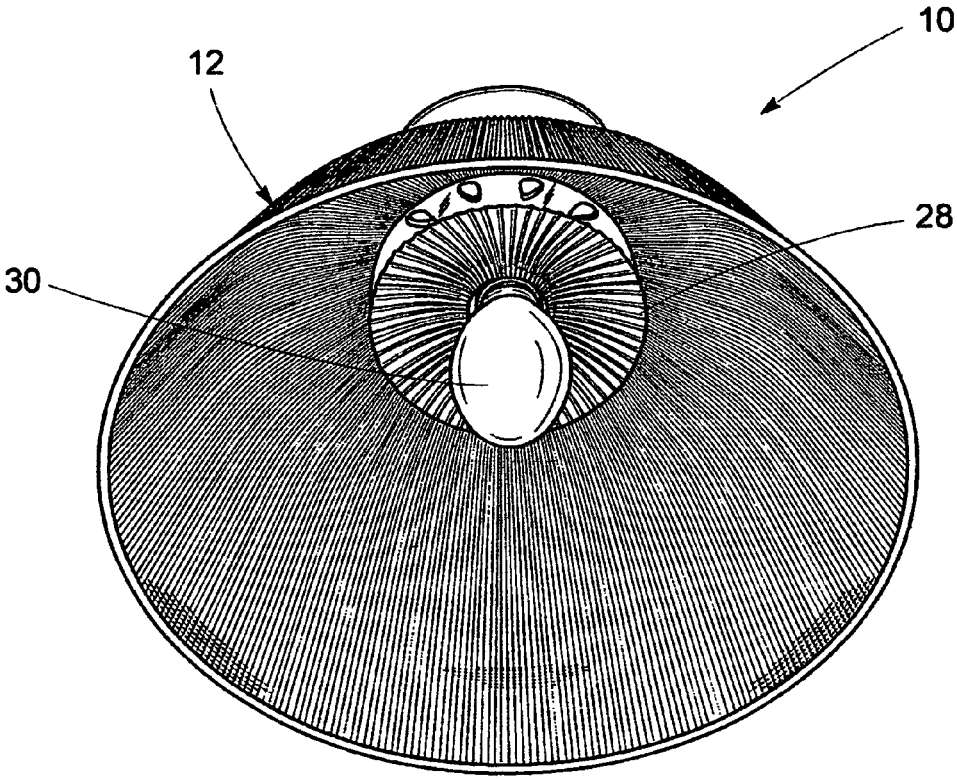
FIG. 3A is a perspective view from beneath the luminaire shown in FIG. 1.
Figure 3B:
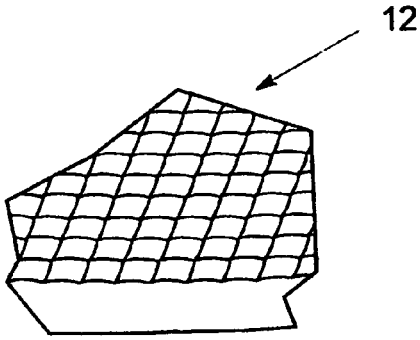
FIG. 3B is a detail view of a portion of inner surfaces of an outer reflector of the luminaire shown in FIG. 3A.
Figure 3C:
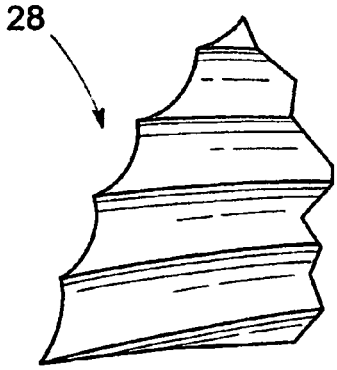
FIG. 3C is a detail view of a portion of inner surfaces of an inner reflector of the luminaire shown in FIG. 3A.

Referring now to the drawings and particularly to FIGS. 1 through 3, a high bay luminaire is seen generally at 10 to comprise a substantially bowl-shaped outer reflector 12 displaceable within the structure of the luminaire 10 by means of an adjustment mechanism 16, the adjustment mechanism 16 comprising an annular base ring 18 fixed to the outer reflector 12, the outer reflector 12 being displaceable along a threaded tubular adjustment member 20 received within a threaded central bore (not shown) of the base ring 18. The tubular adjustment member 20 is fixedly mounted to a ballast housing 14. Rotation of the outer reflector 12 about the tubular adjustment member 20 displaces the outer reflector 12 relative to an inner reflector 28 and a lamp 30 fixed relative to each other, thereby to vary beam spread of the light generated by the lamp 30 and exiting aperture 32 of the outer reflector 12. The adjustment mechanism 16 functions similarly to a corresponding adjustment mechanism disclosed in U.S. Pat. No. 5,791,768, the disclosure of which patent is incorporated hereinto by reference. However, the position of the outer reflector 12 as seen in FIGS. 1 and 2 is adjusted relative to the position of the fixed assembly of the lamp 30 and the inner reflector 28 according to preferred embodiments of the invention. However, it is to be understood that the lamp 30 and the inner reflector 28 can be caused to move relative to the outer reflector 12 through the agency of an adjustment mechanism (not shown) without departing from the scope of the invention.

The ballast housing 14 is essentially conventional in structure and operation and houses a ballast (not shown) which preferably comprises an energy efficient electronic ballast as well as other electrical components necessary for operation of the lamp 30, the lamp 30 preferably being a clear point source lamp such as a high intensity discharge lamp having a clear glass envelope. A metal halide lamp such as a pulse-start metal halide or ceramic metal halide lamp is preferred due to inherent characteristics of such lamping such as high lumen output, long life, low maintenance and energy efficiency. Such lamping is typically characterized by an arc shape, proportion and location within the lamp envelope that, while not comprising a theoretical point source, functions essentially as a point source given the precision optics provided by the outer reflector 12 and the inner reflector 28 as will be disclosed hereinafter.

The high bay luminaire 10 is optionally provided with a prism shield 34 also seen in FIGS. 21 through 24. The structural details of the prism shield 34 will be provided hereinafter. The primary function of the shield 34 is to preclude dust accumulation on portions of the outer reflector 12 covered by the shield, thereby to prevent degradation of the performance of prismatic structures formed on covered portions of the outer reflector 12. The shield 34 is further provided with ventilation apertures 36 which align with ventilation apertures 38 formed in the outer reflector 12, heat produced by the lamp 30 within the interior of the luminaire 10 being vented through the aligned apertures 36 and 38, when the shield is used, or through the apertures 38 to reduce the effect of heat on luminaire efficiency when the shield 34 is not employed.

Figure 4:
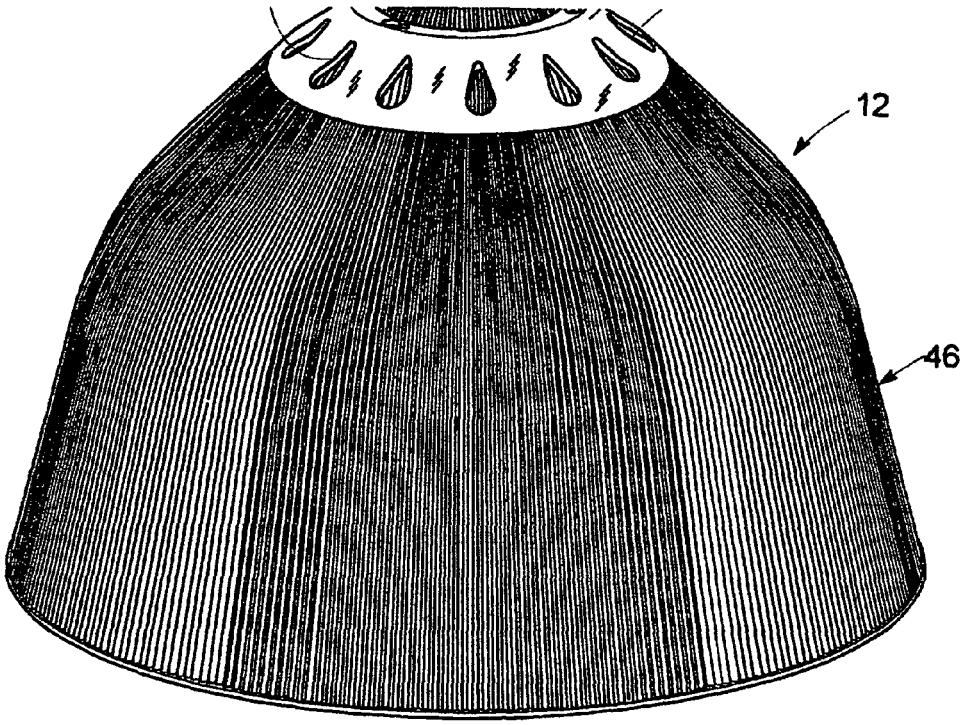
FIG. 4 is a perspective view of an outer reflector configured according to a preferred embodiment of the invention.

With further reference to FIGS. 4 through 16, the outer reflector 12 is seen to be substantially shaped as a bowl that is inverted in a normal use situation. The reflector 12 is formed with an annular base 40 at an "upper" end and a perimetric rim 42 at the end thereof opposite the base 40, the rim 42 defining the aperture 32 of the reflector 12. As is conventional in luminaires of this and other types, the aperture 32 is the opening through which light generated and processed by luminaire optics is directed into a space and onto objectives within the space that are to be illuminated. The ventilation apertures 38 are formed in an annular apron 44 that extends about the periphery of the base 40 between the base 40 and major portions of the reflector 12 having prismatic structures generally represented as 46 in FIG. 4 for general illustration. The outer reflector can advantageously be formed of conventional polymeric materials, particularly acrylics, as well as high grade glass as is also conventional in the art of manufacturing reflector and refractor structures. Acrylic materials are preferred due to cost, weight, appearance, flexibility and repeatability of injection molding processing of relatively large objects with precise and complex geometries. Prisms 48 formed on outer surfaces of the reflector 12 and best seen in FIGS. 8 through 11 are traditional ninety-degree prisms long used in glass and "plastic" luminaire optics, such prisms being capable of the highly efficient optical phenomenon of total internal reflection at both prism faces as well as refraction, before and after, at inside surfaces.

Figure 5:
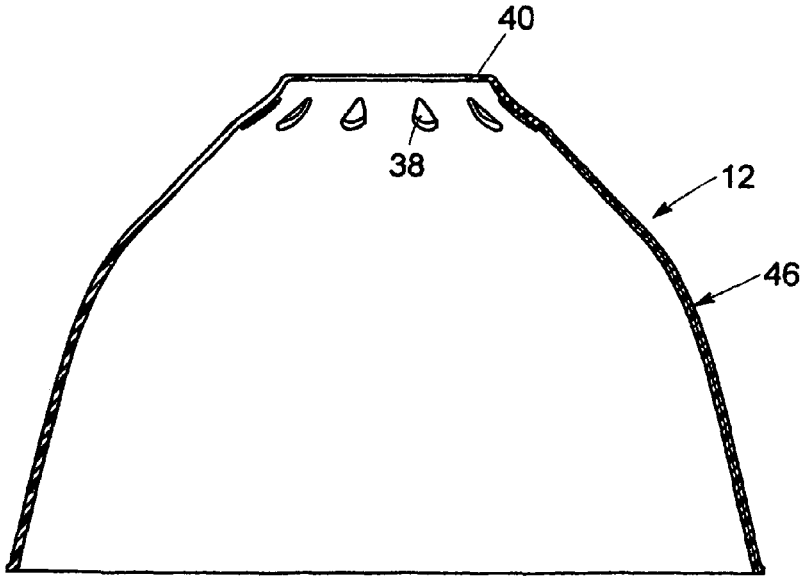
FIG. 5 is a side elevational view in section of the outer reflector of FIG. 4.
Figures 6, 7, 8, 9, 10, 11:
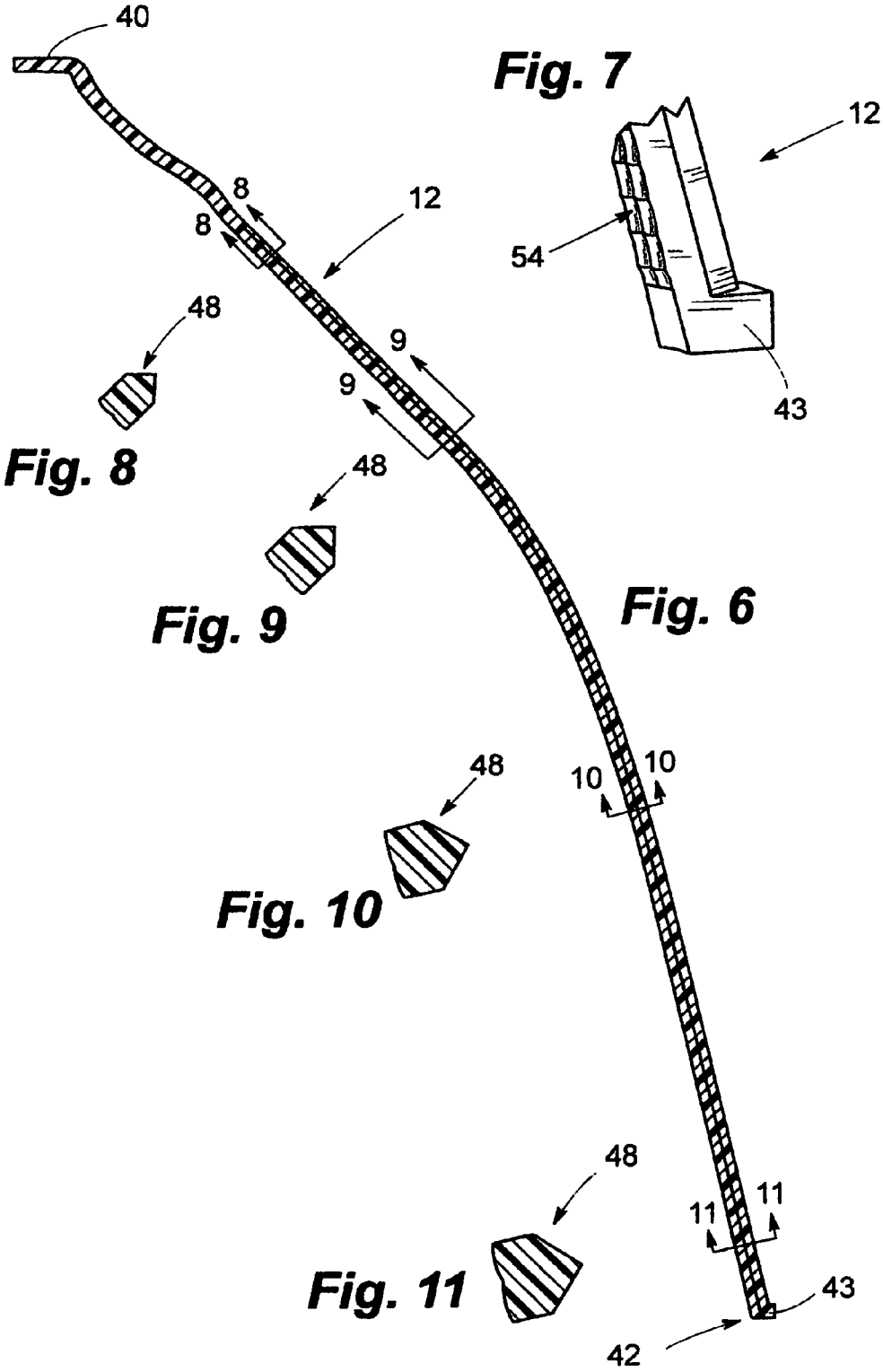
FIG. 6 is a detail view in section of a profile of the outer reflector of FIG. 4.
FIG. 7 is a perspective view of a detail of the outer reflector of FIG. 4.
FIGS. 8 through 11 are detail views of portions of the outer reflector of FIG. 4.

The profile of the outer reflector 12 is best seen in FIGS. 5 and 6 and is chosen to function with a clear lamp such as the lamp 30 which is preferred. Clear lamping typically produces greater light output than coated lamping and allows less light to be transmitted through prisms such as the prisms 48 due to lamp light origination close to the central axis of a reflective structure such as the reflector 12 with a resultant creation of favorable input angles into the prisms, reduction of prism transmission increasing the percentage of light in the 0-60 degree photometric range. Clear lamping further permits greater optical control. Such downwardly directed light is more efficient at providing illumination to lower, task-oriented objectives with a usual high bay application space relative to high angle light and up light resulting from prism leakage.

In the luminaire 10, the outer reflector is displaced as noted above relative to the combination of the lamp 30 and the inner reflector 28 in order to adjust photometric distribution. However, in other embodiments, the combination of the lamp 30 and the inner reflector can be displaced relative to the outer reflector 12. Accordingly, the highest angle light is advantageously caused to be more sensitive to lamp displacement with mid-angle light being made less so. In order to accomplish this result, bottom portions of the reflector 12 about the aperture 32 aims light to mid photometric angles. As the profile of the reflector 12 proceeds upwardly, light is reflected to higher vertical angles until a highest angle of the distribution is attained. Above this highest angle, light is aimed at progressively lower angles at a sufficiently rapid rate so that the lowest aiming angle is reached at the end of the profile contour. Accordingly, more useful light distributions are produced over a wide range of lamp displacements. The reflector 12 is thus shaped near bottommost portions thereof nearly conically, thereby providing a unique appearance relative to conventional high bay luminaires which are substantially vertical at bottom portions and curved over the outer profile. The profile of the reflector 12 further permits relatively deep scalloping especially near bottom portions thereof while providing adequate draft for injection molding.

Figure 12:
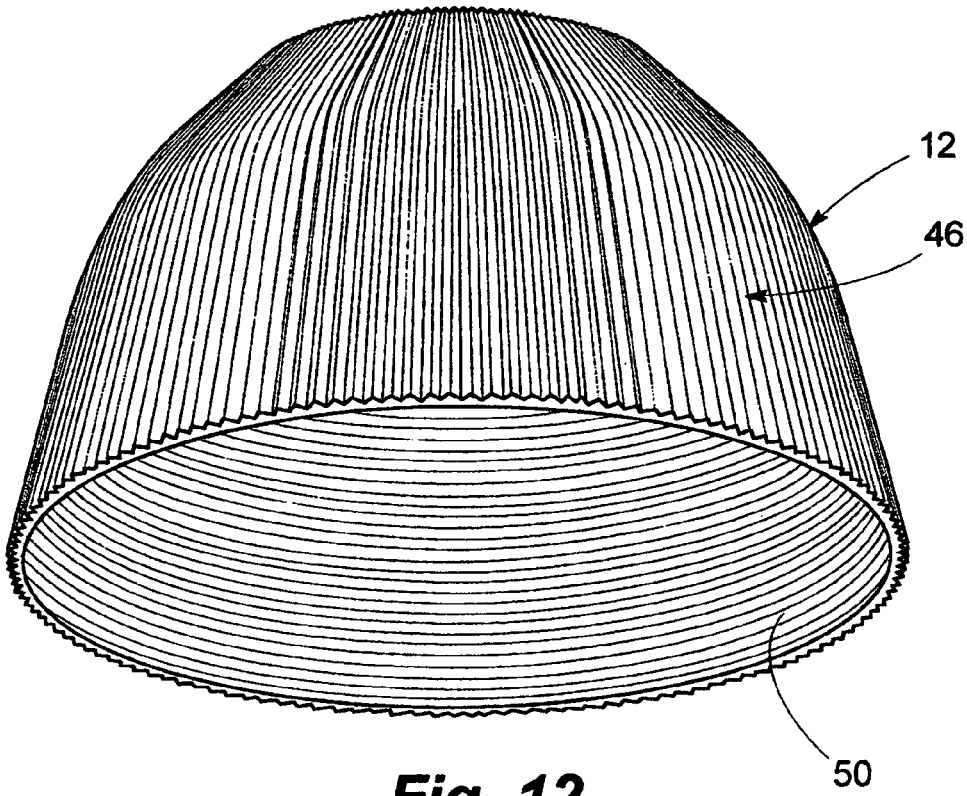
FIG. 12 is a perspective view of an outer reflector of a high bay luminaire configured according to the invention and illustrating formation of concentric scalloping on inner surfaces of the reflector.
Figure 13:
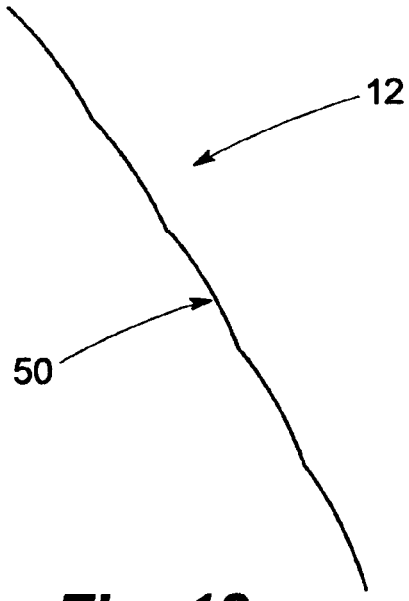
FIG. 13 is a schematic detail view of a portion of the inner surface of the reflector shown in FIG. 12.
Figure 14:
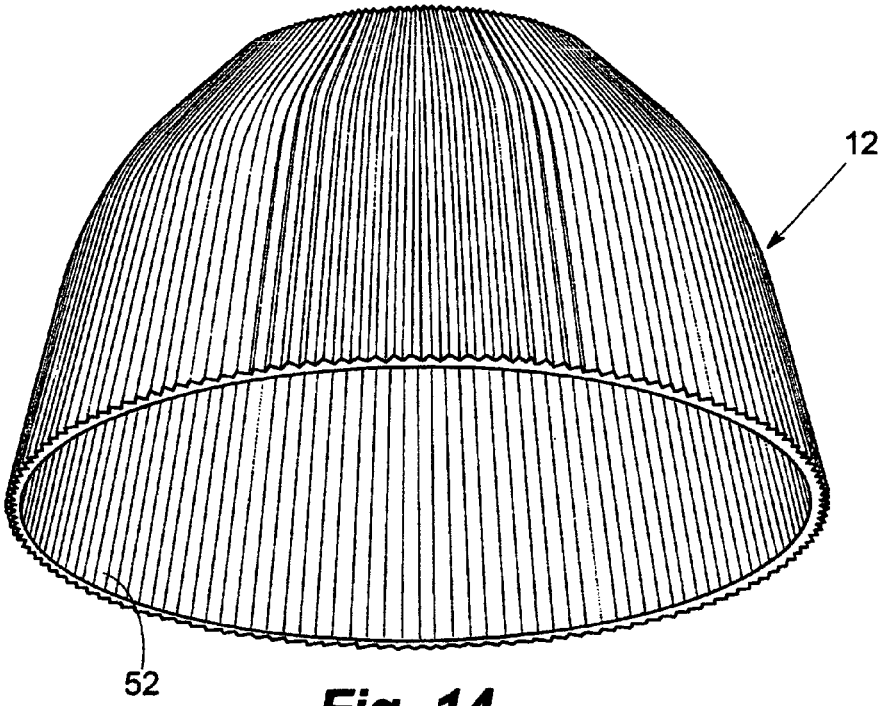
FIG. 14 is a perspective view of an outer reflector of a high bay luminaire configured according to the invention and illustrating formation of radial scalloping on inner surfaces of the reflector.

Creation of the interior topography of the inner surfaces of the outer reflector 12 is best understood with reference to FIGS. 12 through 14, a series of concentric scallops 50 being shown in FIG. 12 without the complication of illustration of radial scallops 52, seen for illustration in FIG. 14, being overlaid on the concentric scallops 50. The concentric scallops 50 primarily function to vertically diffuse reflected light to assure a smooth distribution without bright or dark rings on illuminated surfaces, thereby providing a result not otherwise readily accomplished with the use of a clear lamp together with the specularly reflecting nature of acrylic prisms. Further, this vertical diffusion thus provided produces a spreading of the reflected image or flash as viewed from the inside of the reflector 12, thereby reducing the potential for glare due to the reflected light. Still further, the concentric scallops 50 vertically diffuse light that bleeds through the prisms 48 such as through ridge and valley radii of said prisms such that a lamp image band, that is, a band due to the horizontal spreading of light by the prism radii seen through the reflector 12 is spread in the vertical dimension as well as tapers in perceived brightness from its center outwardly to top and bottom edges. These affects reduce the potential for glare and any visual distraction caused by any bleed-through band. The concentric scallops 50 are chosen to be concave as viewed from the interior of the reflector 12 in spite of a manufacturing advantage in the forming of convex scalloping. While convex scalloping can be employed, light coming into and then out of convex concentric scalloping when formed in the reflector 12, or reflection from the prisms 48, can produce a Moiré interference resulting in less smooth distribution of light in the vertical dimension. The concentric scalloping employed in the reflector 12 produces along with the vertical optical profile of the reflector 12 desired photometric distributions. The concentric scallops 50 maintain a given depth over the full extent of said scallops 50 to the aperture 32 of the reflector 12 while maintaining necessary draft angles for part removal from tooling, thereby causing the optical benefits thus detailed to be manifest over the entirety of the inner surfaces of the reflector 12 over which the scallops 50 are formed. The shape of the concentric scallops 50 can further be appreciated with reference to FIG. 13. The concentric scallops 50 per se can be advantageously employed in a further embodiment of the invention, that is, the outer reflector 12 can be employed essentially as shown in FIG. 12.

Figure 15:
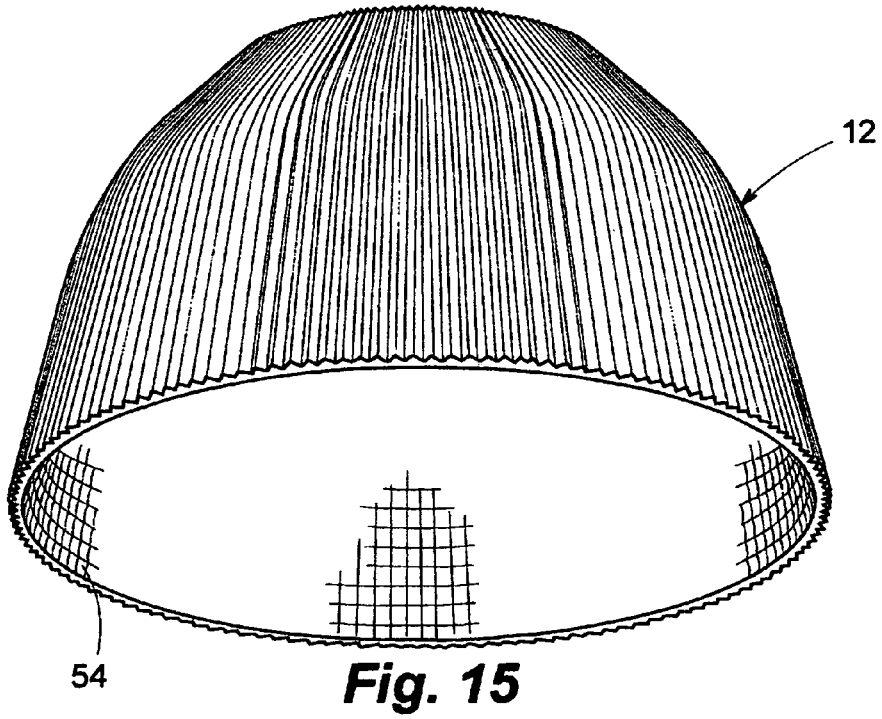
FIG. 15 is a perspective view of an outer reflector of a high bay luminaire configured according to the invention and illustrating a finished inner surface of said reflector having both concentric and radial scalloping of said inner surface.

Radial scallops 52 are seen in FIG. 14 without overlay or incorporation of the concentric scallops 50 for purposes of illustration. The radial scallops 52 are formed on interior surfaces of the reflector 12 as are the concentric scallops 50, the radial scallops 52 being essentially orthogonal to the concentric scallops 50 as seen in FIG. 15. A primary function of the radial scallops 52 is reduction of light leakage from the prisms 48, the radial scallops 52 diverting light from the lamp 30 toward central areas of flat central portions of prism faces via refraction, this function being accomplished by the convex shaping of the radial scallops 52 as viewed from interiorly of the reflector 12. Two radial scallops 52 are preferably provided for each of the externally disposed prisms 48 so that both prism valleys and ridges are avoided in order not to increase light transmission through the prisms 48. Cusps between adjacent radial scallops 52 are precisely aligned in the same vertical plane as either a prism valley or ridge. The number and width of the radial scallops 52 thus varies according to the width and number of the exteriorly disposed prisms 48.

Reduction of prism leakage through the agency of the radial scallops 52 also decreases perceived brightness of any bleed-through lamp image as viewed from outside of the lamping 10 and looking through the reflector 12. Reduction of prism leakage also causes less light to be sent upwardly or at high vertical angles, thereby improving light delivery efficiency into that space below the luminaire 10. The radial scallops 52 also horizontally disperse light bleeding through the prisms 48 although such light is dispersed widely in the horizontal sense due to refraction at ridge and valley radii of the prisms 48. The radial scallops 52 also spread the reflected/flashed image over the interior surfaces of the reflector 12, thereby reducing perceived brightness and associated glare. While the concentric scallops 50 spread reflected image in the vertical dimension, the radial scallops 52 spread the reflected image in the horizontal dimension. In combination, the scallops 50 and 52 produce comprehensive beam homogeneity via the orthogonal affects of said scallops. The radial scallops 52 also stabilize the amount of light output at and near nadir to enable the use of effectively deep shaping of the concentric scallops 50 without causing a spike in output around nadir that would otherwise arise when vertically dispersing light to near nadir angles from large portions of the reflector profile.

Figure 16:
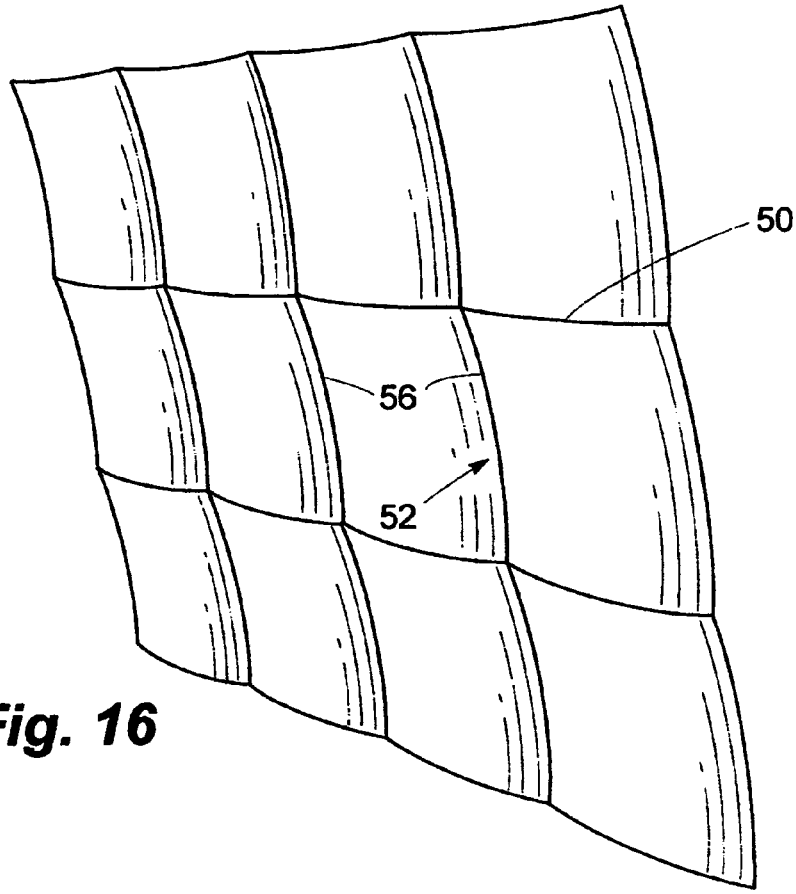
FIG. 16 is a detail view of a portion of the inner surface of the reflector shown in FIG. 15 and illustrating micro-regions defined by concentric and radial scalloping of said inner surface.
Figure 17A:
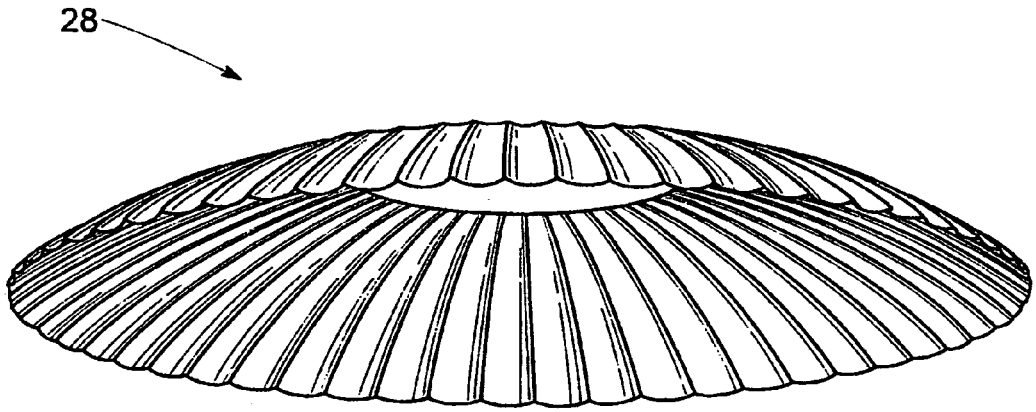
FIG. 17A is a perspective view seen from beneath of an inner reflector of a high bay luminaire configured according to the invention and illustrating a convex radial scalloping of inner surfaces of the inner reflector.
Figure 17B:
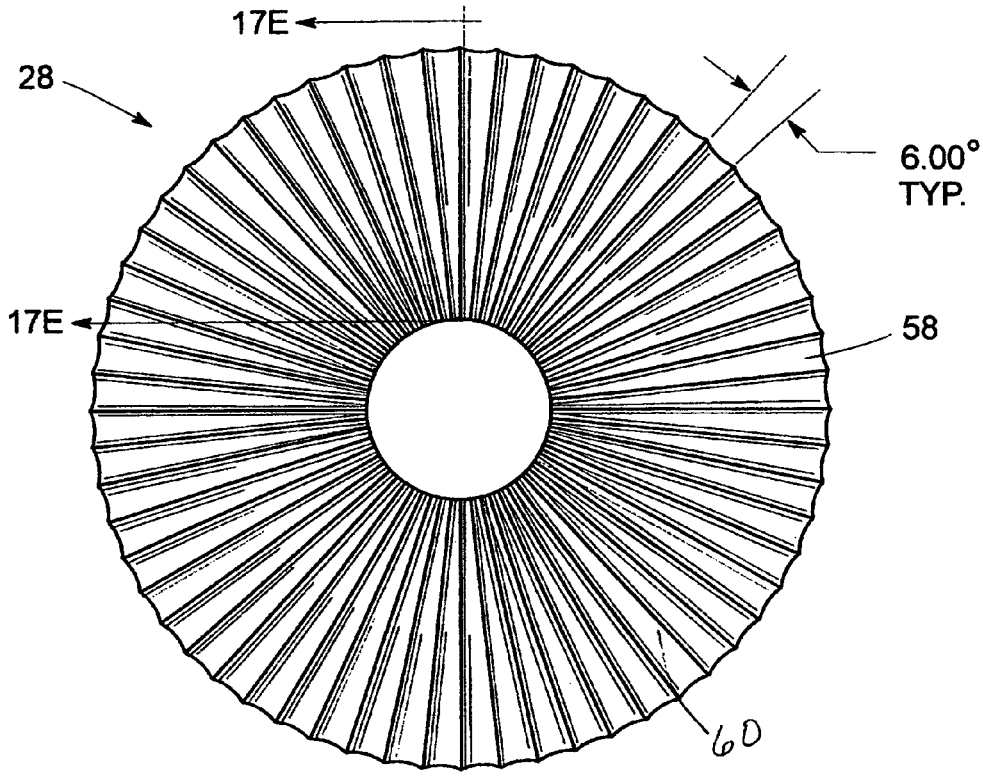
FIGS. 17B through 17N are various views of the inner reflector of FIG. 17A.
Figure 17C:
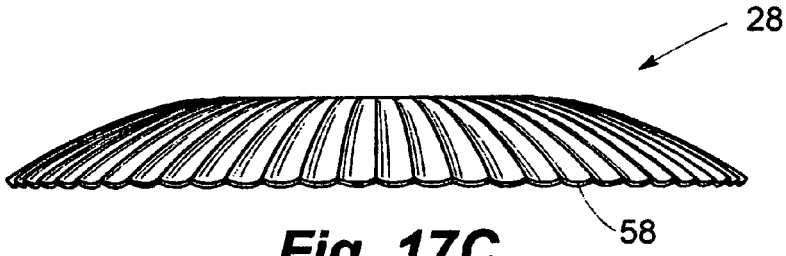
Figure 17D:
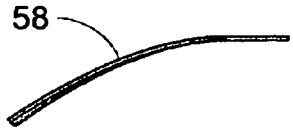
Figure 17E:
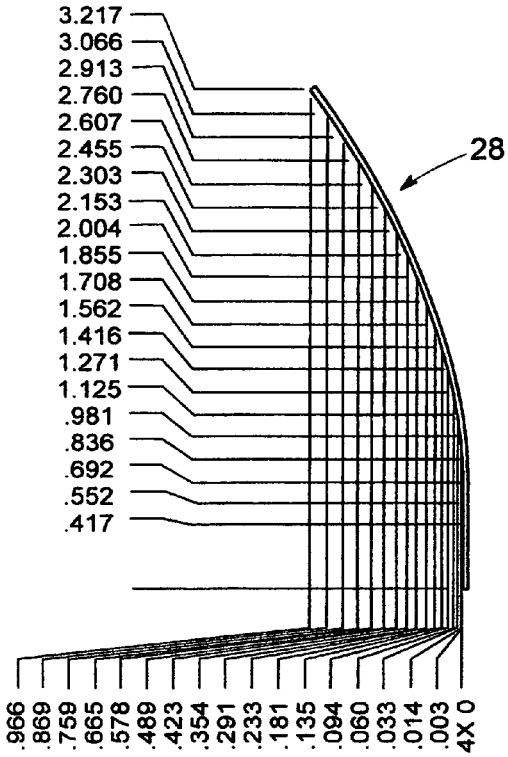
Figure 17F:
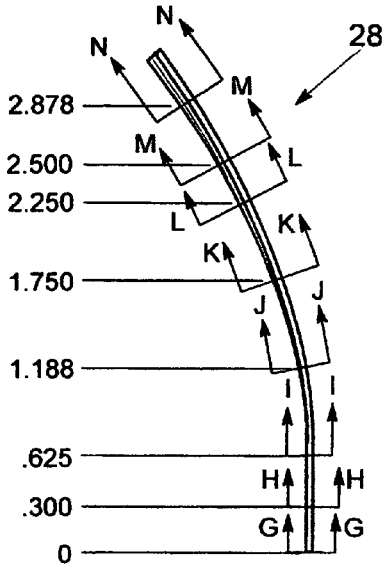
Figure 17G:
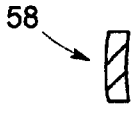
Figure 17H:
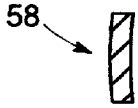
Figure 17I:
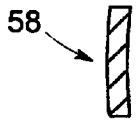
Figure 17J:
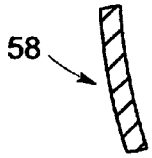
Figure 17K:
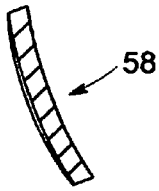
Figure 17L:
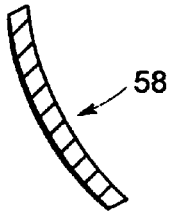
Figure 17M:
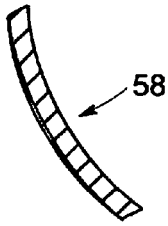
Figure 17N:
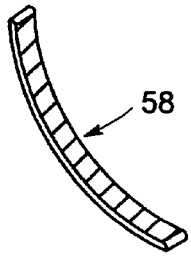
Figure 18:
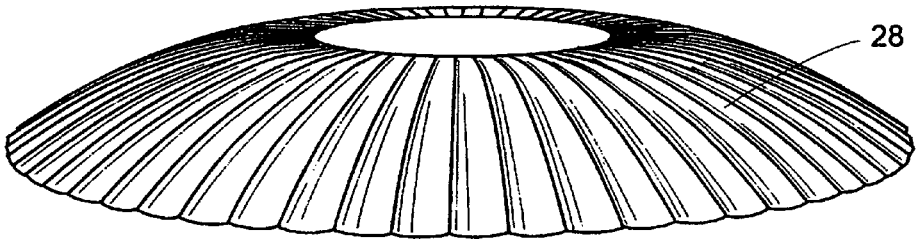
FIG. 18 is a perspective view seen from above the inner reflector of FIG. 17A.

Referring again to FIG. 15 as well as to FIG. 16, contours of multiple lens structures 54 formed by the intersections of the concentric and radial scallops 50 and 52 can best be seen, the lens structures 54 existing in a grid. The very large number of the lens structures 54 have a mixed curvature similar to a "saddle" shape generally. The lens structures 54 thus formed by intersections of the concentric and radial scallops 50 and 52 preserve the independent functionalities of both the concentric and radial scallops 50 and 52 due to the mutual orthogonal orientation of the scallops 50 and 52. Exemplary of the dimensions of the lens structures 54, the lens structures 54 typically and preferably exhibit 20 degrees of arc along arcuate lines 56 with vertical dimensions being normally 0.10" and in horizontal dimensions from 0.12" at the bottom of the reflector 12 near the aperture 32 to 0.05" near the top of the reflector 12. The invention is not limited to these dimensions nor to a specific number of the scallops 50 and 52.

As disclosed above, the inner reflector 28 is mounted in fixed relation to the lamp 30 so that displacement of the outer reflector 12 relative the fixed combination of the lamp 30 and thus the inner reflector 28 varies the position of the arc of the lamp 30 relative to the reflector 12 to produce differing photometric distributions. A single dimensional adjustment therefore achieves different distributions and renders feasible user adjustment in a use environment such as becomes desirable when changes occur in space usage, such as the movement of an assembly line in an industrial facility. Multiple photometric distributions can thus be achieved with a single optical system as disclosed herein. In particular, a fixed mounting of the inner reflector 28 relative to the lamp 30 permits a substantial photometric contribution to light distribution near nadir without instabilities associated with highly specular optics, high specularity being preferred in forming of the inner reflector 28. In the present optical systems, the fixed combination of the lamp 30 and the inner reflector 28 produces a fixed output useful within the entire range of desired total distributions. Accordingly, the fixed lamp/reflector combination produces no more light at nadir than is required by the widest producible distribution and also does not direct light to an angle than is higher than required by the most narrow distribution. In practice, the distribution of the inner reflector 28 and the lamp 30 falls essentially linearly as the lamp/reflector combination moves out from nadir. The outer reflector 12 has a complementary distribution that falls off linearly toward nadir and superimposes nearly additive light to produce desired net photometric distributions. The two overlapping linearly tapering distributions created by the luminaire 10 combine smoothly over a wide lamp/reflector displacement range to provide multiple desirable distributions that vary smoothly between limits of displacement of the outer reflector 12 relative to the fixed lamp 30 and inner reflector 28 combination.

A preferred embodiment of the inner reflector 28 is best seen in FIGS. 2, 3A, 3C, 17A through 17N and 18, the reflector 28 having radial scallops 58 that are convex as viewed from inside of the reflector 28. The optical profile of the inner reflector 28 provides illumination from nadir outwardly to approximately forty degrees from nadir, the profile being particularly useful with a lamp having a clear envelope such as the lamp 30 and thereby provides a greater degree of optical control and increased lumen rating relative to a coated lamp of the same wattage. The inner portion of the reflector 28 is divergent in that light is reflected away from a centerline of the luminaire 10 drawn between zenith and nadir. Outer portions of the reflector 28 are convergent and reflect light across the centerline, the combination of divergent and convergent characteristics of the optical profile allowing the reflector 28 to provide reflected output over the desired angular range while minimizing flux reflected back onto the envelope of the lamp 30 and onto the outer reflector 12. Thus, one bounce and out is assured for reflected light with improvement of output efficiency and reduction of heat and degradation of the lamp 30 as well as other components of the luminaire 10. Further, the profile allows reflected flash and lamp image associated with light output at nadir to be located at the center of the reflector 28 and thus to cover a large radial range. The radial scallops 58 significantly reduce nadir output sensitivity relative to lamp placement and orientation characteristics to thereby allow a single optical system to provide similar photometric characteristics using a broad range of point light sources having differing geometries and photometric distribution. The inner reflector 28 is dimensioned to capture and efficiently redirect a significant portion of upwardly directed flux likely to leak out through the prisms 48 formed on exterior surfaces of the outer reflector 12.

Figure 19:
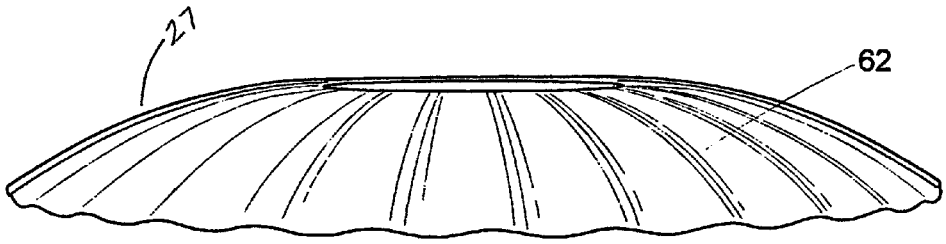
FIG. 19 is a perspective view of an inner reflector of a high bay luminaire configured according to a further embodiment of the invention and illustrating a wave pattern formed in the inner reflector.
Figure 20:
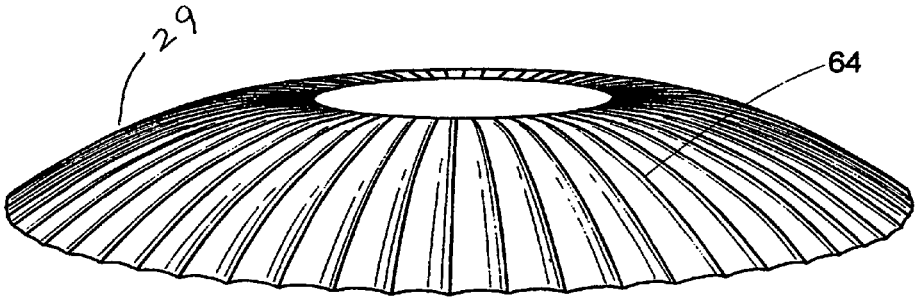
FIG. 20 is a perspective view of an inner reflector of a high bay luminaire configured according to another embodiment of the invention and illustrating a concave radial scalloping of surfaces of the reflector.
Figure 21:
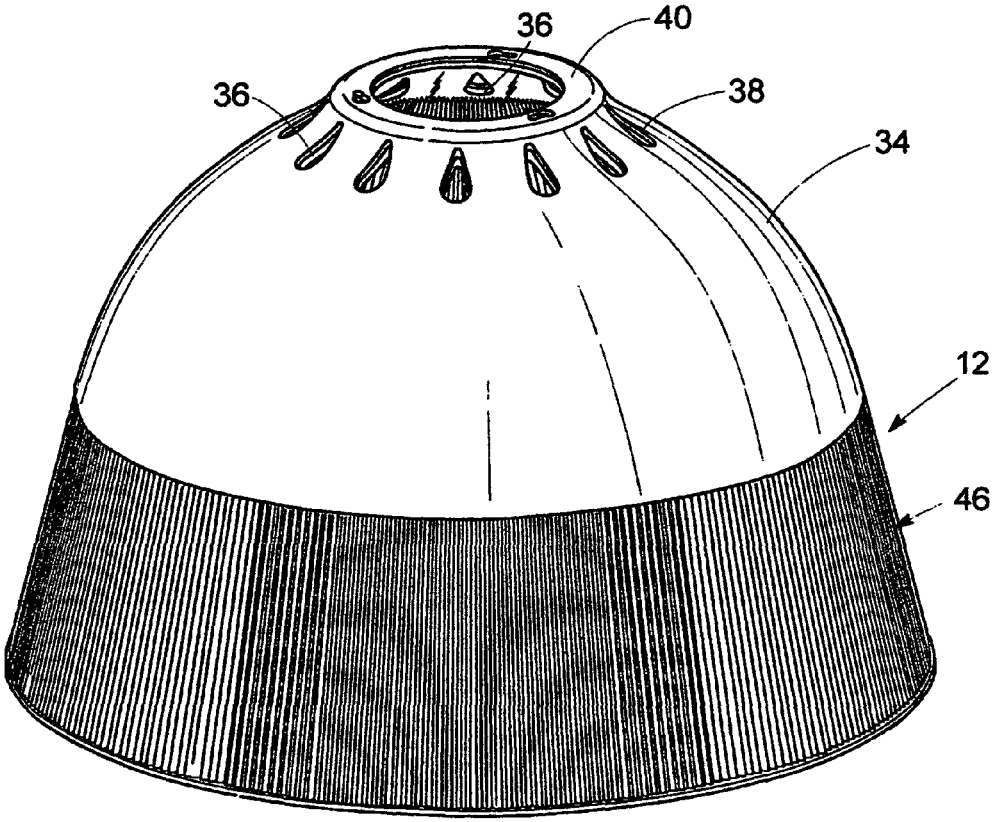
FIG. 21 is a perspective view of a prism shroud configured according to the invention and disposed over an outer reflector such as the reflector of FIG. 4.
Figure 22:
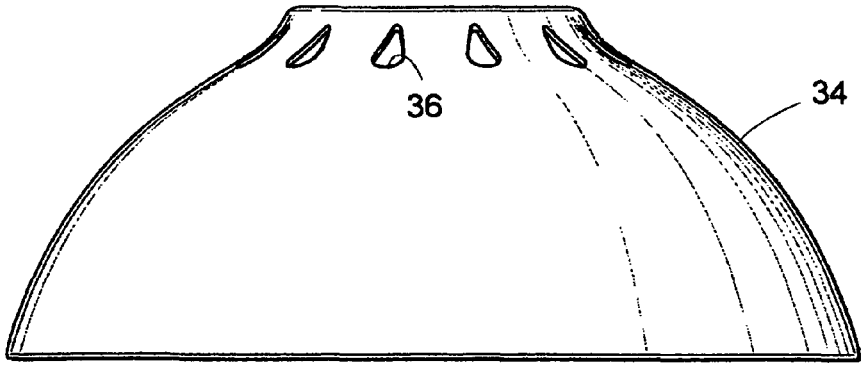
FIG. 22 is a side elevational view of the prism shroud of FIG. 21.
Figure 23:
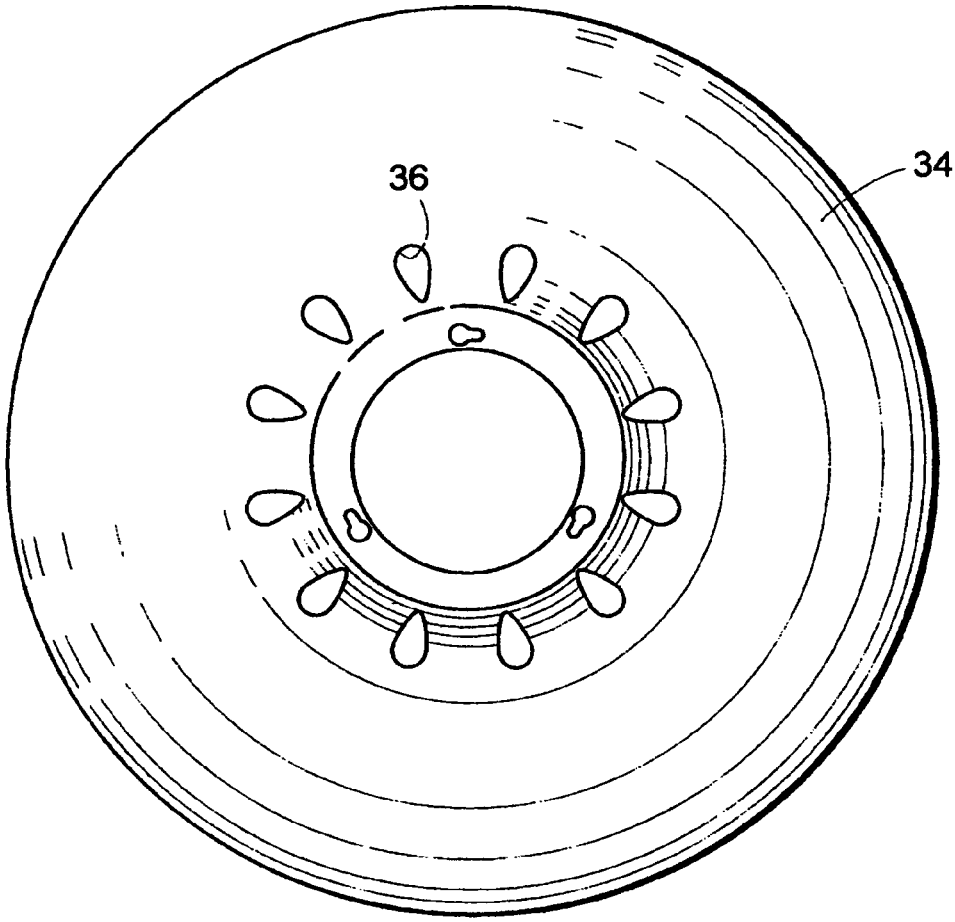
FIG. 23 is a bottom view of the prism shroud of FIG. 21.
Figure 24:
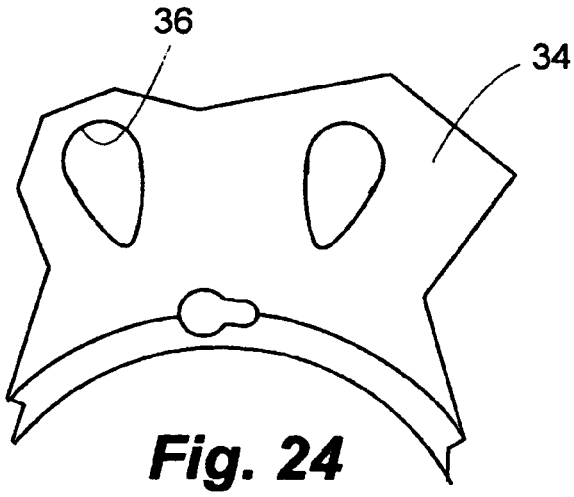
FIG. 24 is a detail view of a portion of the prism shroud illustrating ventilation apertures inter alia.

The convergent and divergent profile of the inner reflector 28 couples functionally with the geometry of the radial scallops 58 to produce desired light output distributions. The radial scallops 58 can be varied in depth in relation to curvature changes along the optical profile of the inner reflector 28, the relationship minimizing stretching and thus degradation of a reflection-enhancing thin film coating 60 formed on the reflector 28 during forming, the coating conveniently being the MiroPress material produced by Alanod. The macro "bowl" shape of the inner reflector 28 would tend to result in excess material when sheet material is formed into the bowl shape if the scallops 58 were not formed in the reflector 28. The width of the radial scallops 58 and number of scallops can be selected for aesthetic affect. While optical properties of the scalloping can be achieved with a wave conformation as seen in FIG. 19 in wave-shaped scallops 62 formed in an inner reflector 27 or in FIG. 20 in concave scallops 64 formed in an inner reflector 29, the convex radial scallops 58 formed in the inner reflector 28 are preferred for various practical reasons including reflector rigidity and reduction of glare by the breaking of flashed image into smaller, more spatially dispersed, distinct images.

The use of a highly specular coating on the inner reflector 28 is permitted by the ability of the reflector 28 to diffuse light by virtue of its profile and formation with radial scalloping, the usual sensitivities associated with highly specular surface coatings in conjunction with clear envelope lamping being greatly reduced. Use of the highly specular coating 60 permits greater optical control and application efficiency. The inner reflector 28 can thus be formed of pre-anodized aluminum sheet with the coating 60 to provide a specular reflectivity of approximately 95%.

Referring now to FIGS. 21 through 24, the opaque prism shield 34 also seen in FIGS. 1 and 2 is seen to be shaped congruently with upper portions of the outer reflector 12 surmounted by the shield 34. As previously noted, the shield 34 functions to prevent dust from collecting on the prisms 48 located on upper and outer portions of the outer reflector 12, those portions of the reflector 12 being more prone to dust collection and thus potential degradation of optical performance due to a more horizontal orientation of said upper portions relative to lower portions of the reflector 12. The shield 34 is preferably formed of a polymeric material with inner surfaces of said shield 34 being a bright white to ensure efficient return of any light leakage through the prisms 48.

When the shield 34 covers upper portions of the outer reflector 12, the aligned apertures 36 and 38 formed respectively in the outer reflector 12 and the prism shield 34 permit a chimney effect ventilation of heat occasioned by vertical hot air movement from the interior of the outer reflector 12 to cool the luminaire 10. This air movement also functions to reduce the opportunity for dust to settle and accumulate on optical surfaces. When the shield 34 is not utilized, ventilation through the apertures 36 reduces heat loads internally of the outer reflector 12. The apertures 36 do not degrade efficiency since the inner reflector 28 serves to block light from incidence on the apertures 36 in any location of the lamp 30 and the inner reflector 28 fixed positionally relative to the lamp 30. The shield 34 also provides an appealing appearance.

The outer reflector 12 is further seen such as in FIG. 7 inter alia to terminate in the rim 42 as aforesaid, the rim 42 being essentially "flangeless" relative to flange-like structures such as are commonly employed in high bay reflectors. The rim 42 is seen to terminate in a decorative trim lip 43, the surface of which is preferably textured to diffuse lamp light reflected through it thereby reducing the potential for glare and to provide a glow at high vertical angles for decorative appeal and for a higher perception of environmental brightness.

The invention can be practiced other than as explicitly disclosed herein, the principles herein disclosed being applicable to a variety of luminaire structures useful in a variety of applications. As one example, a high bay luminaire can be configured according to an embodiment of the invention through substitution of the outer reflector 12 with the reflector disclosed in U.S. Pat. No. 4,839,781, the disclosure of which patent being incorporated hereinto by reference. While the reflector of this patent will not provide the totality of the advantages provided by the luminaire 10 explicitly disclosed herein, substantial advantages are realized even though only the fixed relationships between the lamp 30 and the inner reflector 28 is embodied in a luminaire. Further advantages accrue in such a luminaire when the particular structure of the inner reflector 28 as disclosed herein is employed.

What is claimed is:

1. A luminaire capable of use in illumination of bays or portions of a space such as are enclosed by a warehouse or the like, comprising:

an outer reflector having an aperture and having prisms formed on exterior surfaces thereof, interior surfaces of the outer reflector having concentric scalloping and radial scalloping formed thereon, said scalloping intersecting to define a multiplicity of optically efficient regions;

an inner reflector disposed at least partially within a volumetric space defined by the outer reflector, surfaces of the inner reflector being formed with radial scallops disposed over surfaces thereof and being convex as viewed from internally of the inner reflector; and, at least one lamp at least partially mounted within the volumetric space defined by the outer reflector and having an arc capable of producing light, the inner reflector being mounted in fixed relation to the arc of the lamp to define a ceiling of the luminaire independent of displacement or positional adjustment of the lamp and the inner reflector relative to the outer reflector, thereby providing a desired lighting distribution emanating from the aperture of the outer reflector.

2. The luminaire of claim 1 wherein the outer reflector is displaceable relative to the inner reflector and to the lamp, thereby permitting production of differing photometric distributions.

3. The luminaire of claim 1 wherein surfaces of the inner reflector are formed of a highly specular finish.

4. The luminaire of claim 1 wherein the lamp comprises a clear point source lamp.

5. The luminaire of claim 1 wherein the inner reflector and the outer reflector are mounted concentrically relative to each other.

6. The luminaire of claim 1 wherein the optical system is incorporated into a high bay luminaire, the luminaire having a prism shield disposed over portions thereof.

7. The luminaire of claim 1 wherein the inner reflector and the lamp are formed into an assembly during manufacture of the system, the inner reflector and lamp arc being incapable of relative positional change, the assembly being displaceable relative to the outer reflector, thereby permitting production of differing photometric distributions.

8. A luminaire capable of use in illumination of bays or portions of space such as are enclosed within a warehouse or the like, comprising:

an outer reflector having an aperture and having prisms formed on exterior surfaces thereof, interior surfaces of the outer reflector having concentric scalloping and radial scalloping formed thereon, said scalloping intersecting to define a multiplicity of optically efficient regions;

an inner reflector disposed at least partially within a volumetric space defined by the outer reflector, the inner reflector being formed with a wave or concave pattern over surfaces thereof;

at least one lamp at least partially mounted within the volumetric space defined by the outer reflector and having an arc capable of producing light; and, means for mounting the inner reflector in fixed relation to the arc of the lamp and for displacing the inner reflector and the lamp within the luminaire to vary beam shape and defining an optical ceiling of the luminaire independent of displacement or positional adjustment of the arc of the lamp and the inner reflector relative to the outer reflector, thereby providing a desired lighting distribution emanating from the aperture of the outer reflector.

9. The luminaire of claim 8 wherein the luminaire comprises a high bay luminaire.

10. The luminaire of claim 8 wherein the inner reflector and the outer reflector are mounted concentrically relative to each other.

11. The luminaire of claim 8 wherein the lamp is vertically oriented within the luminaire.

* * * * *